United States Patent [19]

Grimado et al.

[11] Patent Number: 4,475,685

[45] Date of Patent: Oct. 9, 1984

[54] CONTROL SYSTEM FOR EFFICIENT INTERMITTENT OPERATION OF BUILDING HVAC EQUIPMENT

[75] Inventors: Philip B. Grimado, Denville; Vernon E. Holt, Mendham; Nicholas Osifchin, Kinnelon, all of N.J.

[73] Assignee: AT&T Bell Laboratories, Murray Hill, N.J.

[21] Appl. No.: 472,935

[22] Filed: Mar. 7, 1983

[51] Int. Cl.[3] ..... F23N 5/20

[52] U.S. Cl. ..... 236/46 R; 364/557; 374/170

[58] Field of Search ..... 236/46 R, 47; 165/12; 62/231; 374/170, 171; 364/148, 557, 505, 500

[56] References Cited

U.S. PATENT DOCUMENTS 4,244,516 1/1981 Christiansen ..... 236/46 R

OTHER PUBLICATIONS

Electronics & Power, 1/1981, pp. 75–79, D. M. Lush.

Johnson Controls, The Big Idea in Building Automation, pp. OST-1-OST-5.

U.S. Army Corps of Engineers, 8/1/80, Energy Monitoring & Control Systems.

*Primary Examiner*—William E. Wayner

*Attorney, Agent, or Firm*—Alfred G. Steinmetz

[57] ABSTRACT

A system of determining optimum start/stop times for HVAC equipment in a building utilizes quantized inside and outside air temperature values as the controlling data input. Lead-times necessary to achieve the desired control temperatures, given input and output temperature levels are stored in a matrix in a central processor storage. System performance is monitored and results are used to modify the lead-times so that the operating system can more closely achieve the desired results.

15 Claims, 9 Drawing Figures

PRESET SPACE AIR TEMPERATURE SENSORS (°F)

| I | 70 | 72 | 74 | 76 | 78 |
|---|---|---|---|---|---|
| 1 | 0 | 0 | 0 | 0 | 0 |
| 2 | C | 0 | 0 | 0 | 0 |
| 3 | C | C | 0 | 0 | 0 |
| 4 | C | C | C | 0 | 0 |
| 5 | C | C | C | C | 0 |
| 6 | C | C | C | C | C |

PRESET OUTSIDE AIR TEMPERATURE SENSORS (°F)

| J | 74 | 78 | 82 | 88 |
|---|---|---|---|---|
| 1 | 0 | 0 | 0 | 0 |
| 2 | C | 0 | 0 | 0 |
| 3 | C | C | 0 | 0 |
| 4 | C | C | C | 0 |
| 5 | C | C | C | C |

TEMPERATURE CONTROL SEQUENCE FOR OPTIMUM START/STOP TIME DETERMINATION

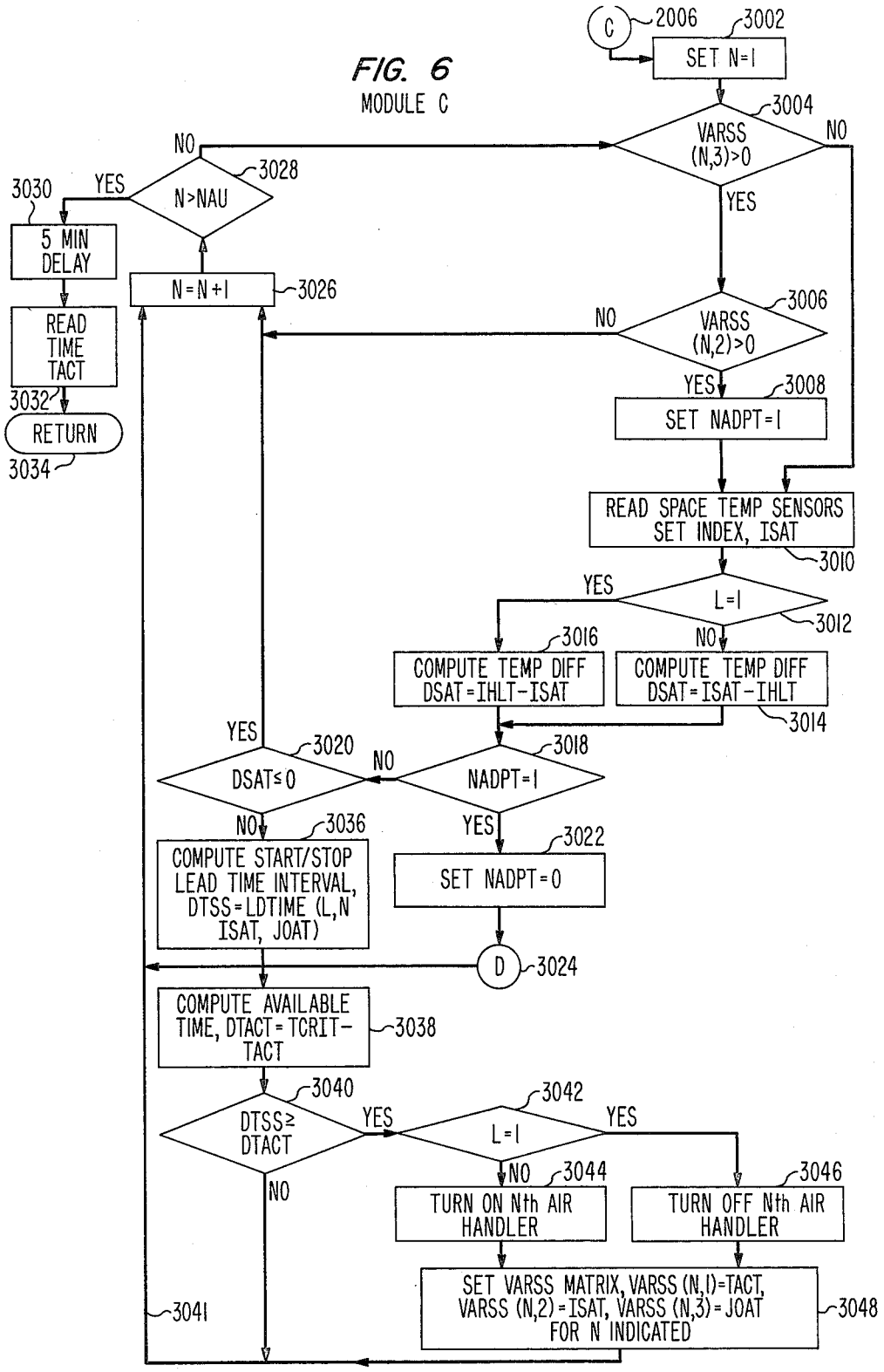
FIG. 6
MODULE C
C
2006
3002
SET N=1
3004
VARSS (N,3)>0
NO
YES
3006
VARSS (N,2)>0
NO
YES
3008
SET NADPT=1
READ SPACE TEMP SENSORS SET INDEX, ISAT
3010
L=1
YES
NO
3012
3016
COMPUTE TEMP DIFF DSAT=IHLT-ISAT
COMPUTE TEMP DIFF DSAT=ISAT-IHLT
3014
3018
NADPT=1
NO
YES
3020
DSAT≤0
YES
NO
3036
COMPUTE START/STOP LEAD TIME INTERVAL, DTSS=LDTIME (L,N ISAT, JOAT)
3022
SET NADPT=0
D
3024
COMPUTE AVAILABLE TIME, DTACT=TCRIT-TACT
3038
3040
DTSS≥ DTACT
YES
NO
3042
L=1
YES
NO
3044
TURN ON Nth AIR HANDLER
3046
TURN OFF Nth AIR HANDLER
SET VARSS MATRIX, VARSS (N,1)=TACT, VARSS (N,2)=ISAT, VARSS (N,3)=JOAT FOR N INDICATED
3048
3041
3028
N>NAU
NO
YES
3030
5 MIN DELAY
N=N+1
3026
READ TIME TACT
3032
RETURN
3034

MODULE D

CONTROL SYSTEM FOR EFFICIENT INTERMITTENT OPERATION OF BUILDING HVAC EQUIPMENT

TECHNICAL FIELD

This invention relates to building space temperature control systems and, more particularly, to an optimum switching or start/stop control system operative to efficiently maintain a predetermined comfort level of temperature for the occupants of a building that is intermittently occupied.

BACKGROUND OF THE INVENTION

An optimum switching or start/stop control is controlled by a stored program controller and is operative to control the turn-on and turn-off times of a ventilating heating or cooling system (sometimes referred to as HVAC) at the latest or earliest possible switching time, respectively, in order to achieve and maintain a desired comfort level during the occupancy of a building. This comfort level is allowed to degrade during unoccupied periods of the building when personnel comfort is not a factor in order to save energy.

Present optimum switching control systems tend to be expensive and many potential users do not implement these systems because of both high initial and high operating cost. Part of this initial high cost is the expense of the many analog temperature sensors plus the expense of analog-to-digital conversion units to couple a digitized version of the analog signal to the stored program controller. A further complication leading to the high operating cost is a tendency of the analog temperature sensing devices to drift over a period of time causing inefficiencies in the operation of the control system and further contributing to high maintenance cost.

SUMMARY OF THE INVENTION

Therefore, in accord with the principles of the invention, significant energy conservation and energy cost savings are obtained in a stored program control system operative to provide optimum switching control of heating/cooling units in a building divided into control zones, rooms or spaces by optimizing the turn-on and turn-off times in relation to building occupancy in order to maintain a temperature range within predefined temperature limits. This environmental control system which may be a heating/cooling system is started at some optimum time prior to occupancy of the building. Starting times for the individual HVAC units in each building space or zone are stored in the control program so that acceptable environmental conditions can be established within each of the many control zones or spaces of the building with minimum energy use. Prior to the termination of occupancy of the building, the environmental control unit in each zone is shut down, allowing the internal environmental conditions such as temperature to float without jeopardizing the acceptable limits of temperature or other environmental conditions within each zone. Selection of an optimum start/stop switching time for each control zone or space is made by the stored program control in response to monitored environmental space conditions in each zone of the building and outside environmental conditions such as outside air temperature.

In particular, environmental conditions such as internal space temperatures and outside air temperatures are obtained through the use of an array of binary temperature sensors which establish ranges of temperature. They advantageously eliminate problems associated with prior art systems such as sensor drift, analog-to-digital conversion and extensive supporting software. A group of these binary temperature sensors in each zone are set to respond to different temperatures at different quantum levels. Each unit is precalibrated to respond at a particular space temperature. The outside air temperature is monitored by a plurality of precalibrated binary temperature sensors responsive in quantum steps to cover a range of temperatures. The binary sensors used in the control system herein are operative to close a circuit when a predetermined temperature is reached. The open and close circuit temperature thresholds of each of the group of binary temperature sensors determine a range of quantum stepped values utilized to determine a turn-on/turn-off optimum switching time for the environmental space control equipment in each zone.

The stored program control used herein is a self-adaptive, self-learning instruction arrangement, wherein the transient building space environment response to temperature change lead times are periodically adjusted to correspond to the actual measured building temperature change response. This means that the system operates efficiently through seasonal changes, solar load changes and even changes in neighborhood envoronment such as new nearby building construction.

BRIEF DESCRIPTION OF THE DRAWING

A full appreciation and understanding of the invention may be ascertained by reference to the following specification and accompanying drawing in which:

FIGS. 3 through 8 disclose flow charts to illustrate how the optimum switching time for turn-on and turn-off is determined and implemented in a stored program control.

DETAILED DESCRIPTION

Figures 1, 2:
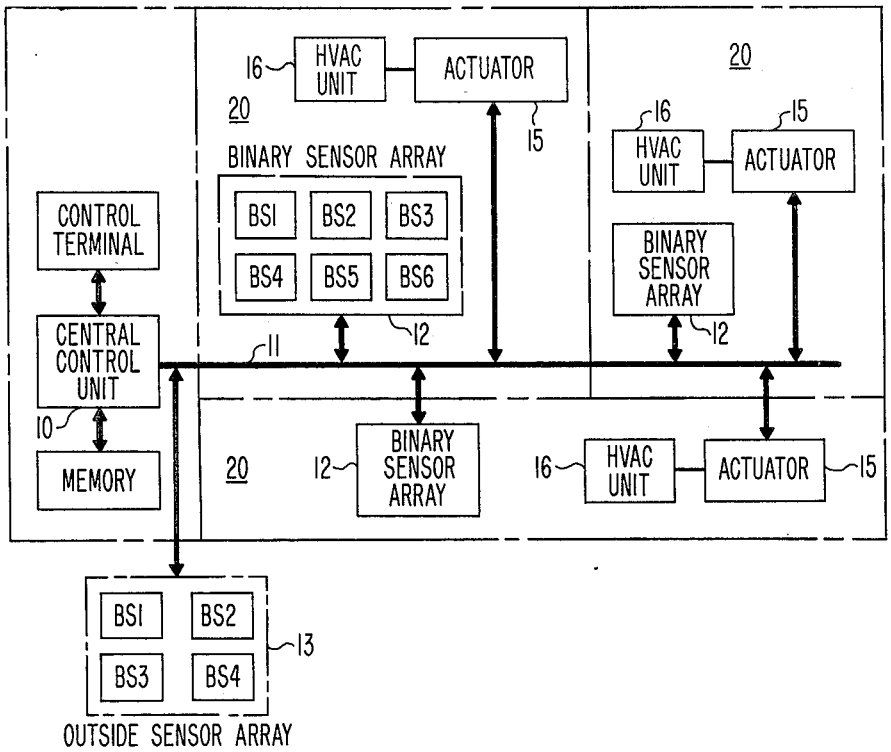
FIG. 1 is a block diagram illustrating an environmental control system to control the space air temperature in various zones of a building utilizing optimum switching times for turn-on/turn-off of equipment.
FIG. 2 is a table showing how an array of binary temperature sensors is distributed to cover a temperature range for inside and outside temperature sensing in an illustrative system.

A stored program controlled heating ventilating or air conditioning (HVAC) plant is disclosed in FIG. 1, in which, individual spaces of a building have individual HVAC units and temperature sensors. Energy savings are achieved by turning off the HVAC in each space at an optimum stop time before the building becomes unoccupied and allowing the building space air temperature of each space or zone to henceforth float. This optimum stop time is selected by the control system so that the building space air temperature during this float does not rise above some optimum value. Similarly, the HVAC unit in each space or zone is turned on at an optimum start time prior to occupancy so that each space or zone is at a comfortable temperature at the start of occupancy.

As is shown in FIG. 1, a central control unit 10, including a stored program control, is connected via a bus 11 to a series of binary-type sensors 12 in each designated individual air space 20 of the building and to a series of binary-type temperature sensors 13 on the outside of the building. The individual temperature sensors are binary sensing devices including binary on/off switches, each responsive to a different particular preset temperature. Such devices are available commercially and need not be disclosed in detail. The preset temperatures selected for the digital temperature sensors in the illustrative embodiment are shown in the table in FIG. 2. Individual sensors to sense space air temperatures respond at 70°, 72°, 74°, 76° and 78° F. A contact in the 74° F. unit, for example, is open when the temperature is less than 74° F. and closed when the temperature equals or exceeds 74° F.

As is apparent from examination of the table, each attainment by the environment of a certain quantum level of temperature produces a unique binary word from the binary states of the array of individual sensors; each word being utilized by the stored program control. Using the exemplary temperatures shown in FIG. 2, if the building space air temperature is below 70° F., the control word is all zeros which represents a value of I=1. If the building space air temperature is from 74° F. to just less than 76° F., the control word is 11100 representing an I=4. Similarly, if the outside air temperature is, for example 78° F., the control word is 1100 or J=3. These control words are used by the stored program control to calculate lead times for turning on or turning off air handling units.

The central controller 10, including the stored program control, responds to the information supplied by the binary temperature sensors which characterize the space air and outside air temperature to ascertain optimum start/stop times for the various HVAC units 16. As shown in FIG. 1, the central controller 10 is coupled to actuators 15 and operates under the stored program control to turn-on or turn-off the HVAC units 16 to maintain the desired temperature ranges.

The initial step in achieving such control in, for example, a controlled air conditioning system is to preestablish a high limit of space air temperature permitted in each defined space which is not to be exceeded when the building is occupied. Similarly, a low limit space temperature must be defined for each space for control of heating units, and the times that the building becomes occupied and unoccupied must be defined. This information, as well as, the number of HVAC units is used by the stored program control as basic parameters in initializing its stored program control, as shown in process symbol 1002 of the basic control routine shown in FIG. 3.

In the case of the illustrative cooling units used herein in illustrating the principles of the invention, a high temperature limit is established to which the building space air temperature is allowed to float without causing discomfort to the occupants. The air temperature is defined within a quantized range around the ideal temperature as determined by the resolution permitted by the quantum level jumps in temperature between different binary temperature sensors, and a number of sensors is selected to adequately cover this range. In the illustrative embodiment, this range as shown in FIG. 2 extends from 70° F. to 78° F. in five quantum steps for building space air temperatures and from 74° F. to 88° F. in four quantum steps for outside air temperatures. The range and quantum differentials of air temperatures preselected to cover the anticipated temperature range are dictated by the local climate and the precision of resolution desired to allow tracking and prediction of temperature changes.

The stored program control considers three distinct temperature ranges in the control of each HVAC unit, in this particular example, a cooling unit. These temperature ranges include an outside air temperature range, a building space air temperature range during building occupancy and a building space air temperature range during building unoccupancy. A high level temperature value is selected for cooling purposes. This temperature represents the highest building space air temperature that is acceptable when the building is occupied. This value does not represent the building space air temperature at which the building is normally maintained but rather, represents a space air temperature to which the building space or zone is allowed to float to after the cooling units have been turned-off at the end of the occupancy period or to be attained at the beginning of occupancy after turn-on.

Each sensor array defines a temperature range bound by the highest and lowest preset temperatures of the sensors. The sensors operate by opening and closing circuits that may be interpreted by the stored program control as high and low (i.e., one or zero) signal levels. For a given temperature range, the zero and one supplied by the sensor array, as indicated above, is a word corresponding to an interger I which defines the temperature with the quantum resolution which, in this particular example, is 2° F.

Figure 3:
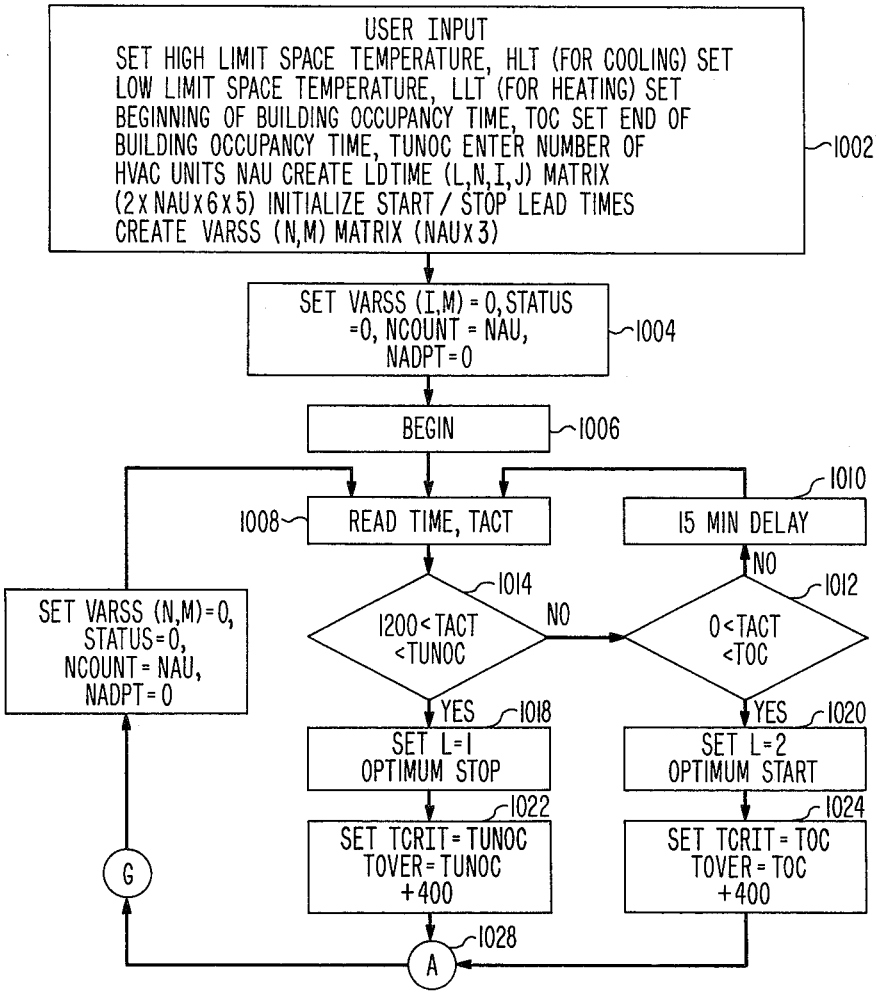

Initial information is inserted into the stored program as shown in the initial process symbol 1002 in FIG. 3. The high limit building space air temperature in controlling cooling is entered as a number IHLT related to the corresponding control word of that temperature in a system using binary temperature sensing arrays. A low limit building space air temperature is entered in a system if it is also controlling the heating units. A beginning time and end time of building occupancy is entered. The desired limit temperature must not be exceeded during the occupancy period between these two times. The number of cooling units is also entered.

A LDTIME matrix is created and each unit is assigned start/stop switching time parameters which define a lead time associated with each cooling unit in each space necessary for a turn-on or turn-off of a unit to achieve or float to some limit temperature for any given outside air temperature.

A second matrix VARSS is created and is used as an intermediate matrix in the stored program to secure raw data for calculation and to modify lead-time values in the LDTIME matrix.

In the matrix LDTIME (L,N,I,J), the index L is used to access the numerical value of the stop and start lead-times. L=1 for the stop lead-times and L=2 for the start lead-times.

The index N is used to identify a particular building zone or cooling unit. The indexes I and J are used to represent the word associated with different air temperature quantum levels for the building space and outside air, respectively.

This matrix is initially preset with start/stop parameters that establish a starting point. Due to the self-adaptive features of the stored program control, any values can theoretically be used, however, an educated guess by those skilled in the art will produce values that will enable the stored program control to converge to the correct operating values more rapidly.

Next, the VARSS matrix is established. This matrix functions as an intermediate storage matrix for intermediate parameters that are established by the stored program control instructions and are used to calculate current cooling lead-time parameters populating the LDTIME matrix.

In the matrix VARSS (N,M), the index N is used to identify a particular building zone or cooling unit. The index M=1, 2 or 3 is used to access and store the actual time a start or stop action was taken and the numerical index values of the I and J quantum building and outside air temperature level at the time of this action, respectively.

The VARSS matrix is initially populated with zeroes as indicated in process symbol 1004. The word STATUS is set equal to zero; NCOUNT is set equal to the number of air handling units NAU (i.e., cooling units), and NADPT is set equal to zero. These mnemonic words, as well as words used subsequently, are identified in the following list.

LIST OF PROGRAM NMEMONICS

Figure 4:
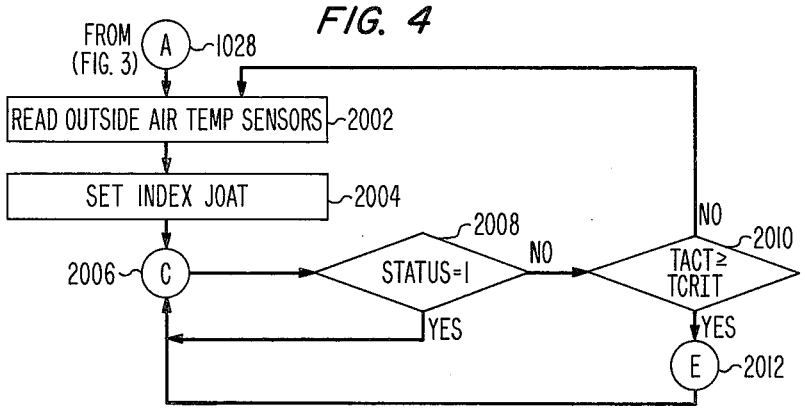
Figure 8:
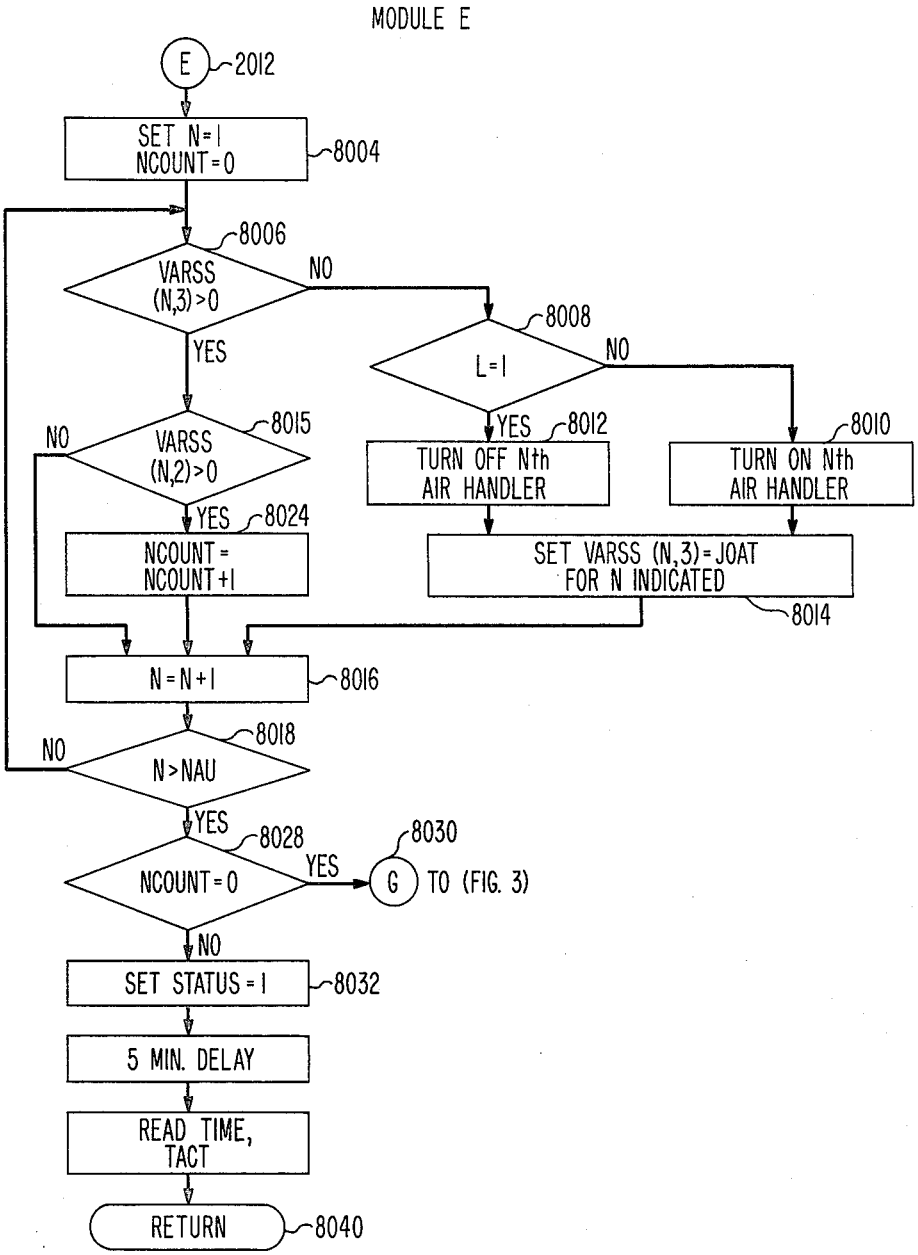

DSAT-Space air temperature difference from high limit temperature=IHLT−ISAT, or =ISAT−IHLT;

DTACT-Available period of time to reach TOC or TUNOC;

DTSS-Computed optimum start/stop time interval;

IHLT-High limit building space air temperature quantum level;

LDTIME (L,N,I,J)-Matrix containing optimum start/stop lead-times for each building zone or cooling unit;

NADPT-An indicator used in program routine module C;

NAU-Number of air handling units, user input;

JOAT-an integer specifying a particular outside air temperature quantum level;

ISAT-an integer specifying a particular building space temperature quantum level;

STATUS-An indicator used in logic modules A and E, FIG. 4 and 8;

TACT-Actual time read from real time clock;

TCRIT-Time set equal to TOC or TUNOC and used as a control time in the operation of the program;

TOC-Time building becomes occupied user input;

TOVER-Maximum operation time of optimum start/stop stored program control;

TUNOC-Time building becomes unoccupied, user input;

VARSS (N,M)-Matrix used for adjusting LDTIME start/stop matrix elements, the number of elements are (NAU×3);

The main control routine of the stored program control in FIG. 3 is entered at the begin symbol 1006 after the above-indicated matrices have been established in the stored program control. This main routine operates to initialize the data entered above, and to monitor the elapsed time during the day and determine if the control system should be operating in its start-up or shutdown mode.

The next process symbol 1008 operates to read the actual time of the day TACT and the routine proceeds to decision symbol 1014 to determine if the actual time of day is between 12 noon and the time when the building will become unoccupied. If it is, the indicator L is set equal to one in process symbol 1018, and if it is not, the routine proceeds to decision symbol 1012 and inquires if the actual time is prior to the time of occupancy. If it is, the indicator L is set to the value 2 and if not, the routine loops back to process symbol 1008 after a 15 minute delay imposed by process symbol 1010. Hence the instruction of the initial process symbol 1008 of the routine of FIG. 3 checks every 15 minutes to see if it should be in a start or stop mode of operation.

If L has been set to one, the routine proceeds to process symbol 1022 to set the time period during which the start-up mode is operative. In process symbol 1022, TCRIT is set equal to the time the building becomes unoccupied and TOVER, the maximum operation time of the start-up mode, is set equal to TUNOC +400 (i.e., four hours). The actual time period during which the results of a shutdown are monitored, in this example, is limited to a time approximately four hours after the building becomes unoccupied.

Similarly, if L has been set equal to two, the instructions of process symbol 1024 set the TCRIT equal to TOC and by setting TOVER equal to TOC +400, assures that the effects of start-up operations, in this example, will be monitored for a period of four hours after the building becomes occupied. The period of four hours is arbitrarily selected for this example and may be adjusted to other values if environmental conditions so dictate.

After the instructions of the process symbols 1022 and 1024 have established the operating time of the control system during which the lead time parameter results are monitored and adjustments are made, the routine proceeds to connecting terminal 1028 which initiates the control routine of FIG. 4 to enable monitoring of the temperature sensing arrays.

The instruction of the first process symbol 2002 in the routine of FIG. 4 directs that the on/off states of the array of outside air temperature sensors be read. The following process symbol 2004 converts the reading to its proper J index number, and the routine proceeds to connect terminal 2006 which enters routine C shown in FIG. 6.

The routine C in FIG. 6 is operative for each cooling unit in each individual building space and causes the various building space air temperatures associated with that space to be read and recorded. It devises a space air temperature differential between the high limit temperature (in the cooling example used) and the actual building space air temperature and utilizes these parameters to access the proper lead-time which is stored in the LDTIME matrix for optimum start/stop switching operation of the air handling cooling unit. These results of routine C dictate the course of action to be taken by the optimum start/stop system; should the cooling unit be started, stopped or left alone. When start/stop action is to be taken, routine C populates the VARSS matrix once action is taken. Following this, the results of the action taken are monitored to determine when to call subsequent routine D in FIG. 6 to adjust or adapt the proper lead times as discussed below.

The instruction of the first process symbol 3002 of routine C sets N equal to one, where N is the identifying number of a particular air handling unit. The number N is incremented by the routine so that all air handling units are covered in the interactive operation of routine C. The VARSS matrix is examined via instructions of the decision symbol 3004 to check the value of the VARSS (N,3) element. If it is greater than zero, it indicates that the air handler has been previously turned on or off. If it is greater than zero, the subsequent decision symbol 3006 determines through the numerical value of the VARSS (N,2) element whether the LDTIME matrix element for the particular air handling unit has been adjusted. If this value is greater than zero, the routine proceeds to process symbol 3008, which sets the value of NADPT equal to one; a value which is used subsequently in this routine to determine if the routine should subsequently proceed to routine D in FIG. 6.

If the value of VARSS (N,3) is determined to be zero in decision symbol 3004, it is obvious that no action has been taken concerning that particular air handling unit, and the routine proceeds directly to process symbol 3010 whose instructions read the building space air temperature associated with the particular air handling unit N and sets the proper index number associated with it to a coded temperature value ISAT.

The routine C instructions continue to decision symbol 3012 which evaluates the current value of L in order to determine if the program is operating in a start-up or shutdown mode for this particular air handling unit. If it is operating in a shutdown mode, the routine proceeds to process symbol 3014 which is operative to compute the temperature differential DSAT between the preset high limit temperature IHLT expressed as an integer temperature quantum level and the existing space air temperature ISAT also expressed as an integer temperature quantum level. Subsequent to this evaluation, the instructions of routine C proceed to decision symbol 3018 and inquire if NADPT equals one. If NADPT equals one, it means that the particular air handling unit has been turned on or off and that now the building space environment is to be monitored to evaluate adjustment, if any, to the appropriate LDTIME matrix element. The value NADPT is subsequently set to zero in process symbol 3022, and the routine D in connecting symbol 3024 is engaged to change the associated parameter value populating the LDTIME matrix.

If NADPT does not equal one, the routine proceeds to decision symbol 3020 which inquires if the value DSAT, the difference between ISAT and IHLT, is equal to zero. If DSAT is not equal to zero, the instructions of the routine proceed to process symbol 3036 which is operative to compute a start/stop lead-time DTSS. DTSS is a particular element of the LDTIME matrix. It represents the time period in hours for the building space temperature to float to the high limit temperature quantum level specified as IHLT for shutdown when L=1 and for the start-up mode when L=2, it represents the time period required to pull-down the building space temperature to the IHLT quantum temperature level. If DSAT equals zero, the routine proceeds to process symbol 3026 whose instructions increment the value for N to enable the routine to work with the next air handling unit in a sequential fashion.

Instructions of decision symbol 3028 check to verify if this incremented number exceeds the actual number of air handling units. If it does, the routine is delayed for five minutes in process symbol 3030 followed by a reading of the actual time TACT as instructed by process symbol 3032, whereupon the routine C terminates and the control returns to routine A at the return symbol 3034. If the incremented number N does not exceed the number of air handling units, the routine returns to decision symbol 3004 whose function has been described above.

Returning to the processing by instructions of process symbol 3036, once the value DTSS has been determined to indicate the time period required for the building space temperature to reach the high limit IHLT temperature quantum level, instructions of a following process symbol 3038 compute whether the actual time needed for this adjustment is available between now and the time when the building is occupied or unoccupied.

The value DTACT, that is the time available to the occurrence of TUNOC or TOC, is compared with the DTSS values by instructions of the decision symbol 3040. If the lead-time to achieve a desired temperature exceeds the time to TUNOC or TOC, the routine proceeds to the decision symbol 3042 to determine if we are in a shutdown or start-up mode. In a start-up mode, an air handling unit is turned-on, via process symbol 3044, and in a shutdown mode, an air handling unit is turned-off in process symbol 3046. Following the switching of an air handler in either block 3044 or 3046, the VARSS matrix is set in process symbol 3048 for this particular air handling unit with values required in adjusting the parameters populating the LDTIME matrix. The value VARSS (N,1) is set equal to TACT; VARSS (N,2) is set equal to ISAT; and VARSS (N,3) is set equal to JOAT for the particular air handler N.

If the value of lead-time DTSS is less than the available time DTACT to TOC and TUNOC, the routine returns by lead 3041 to process symbol 3026 where N is incremented to the number of the next air handling cooling unit.

Figure 7:
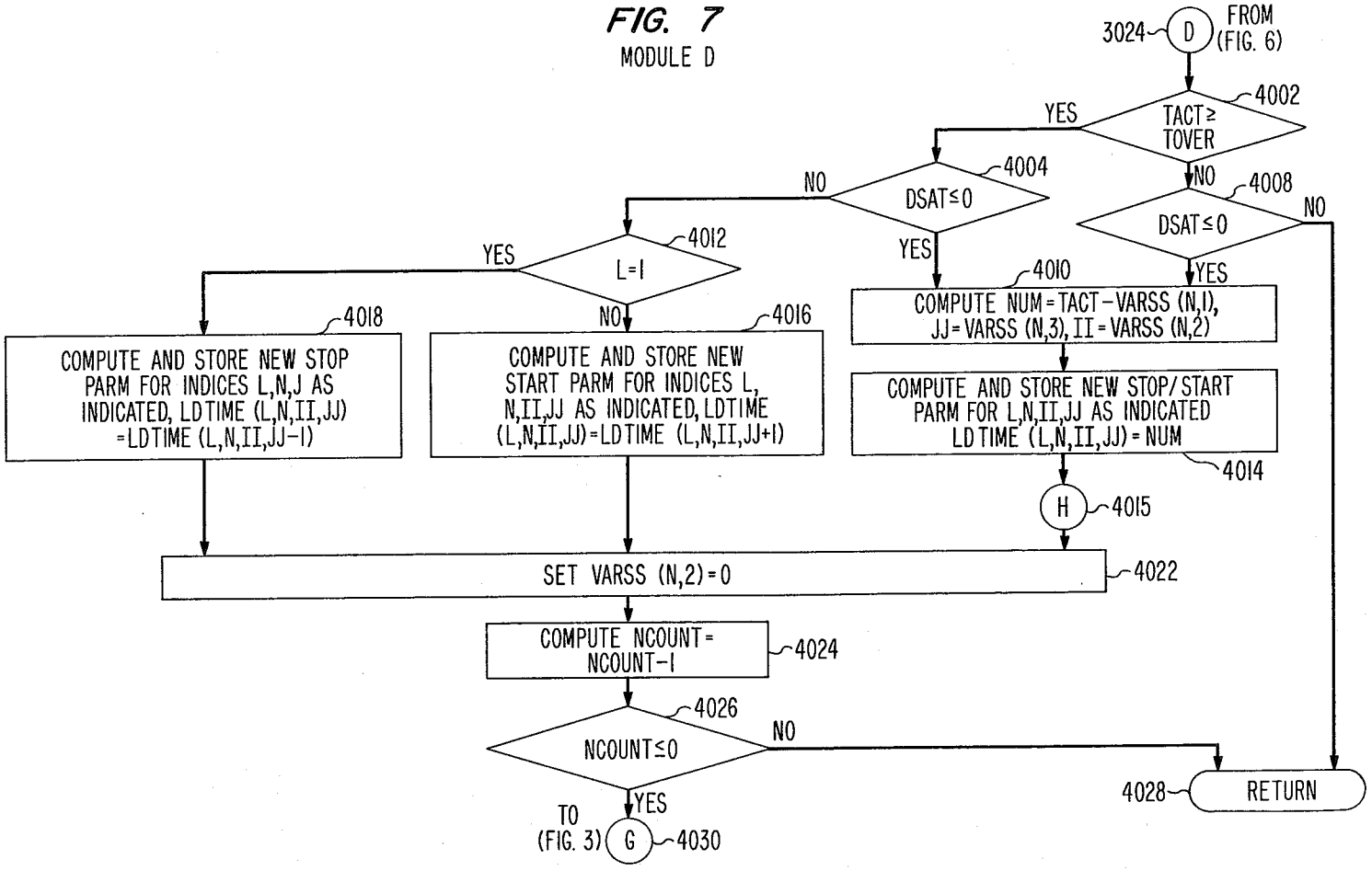

Returning to the decision evaluated by instructions in decision symbol 3018, if the value for NADPT equals one, meaning that the lead-time parameters have not been adjusted, the value for NADPT is set to zero in process symbol 3022, and the routine D of FIG. 7 is engaged. The routine D examines the storage matrix VARSS to see when a particular air handling unit i.e., cooling unit was turned on or off. It uses this information and the actual building air temperature response to make adjustments to the appropriate lead-times contained in the LDTIME matrix.

Routine D shown in FIG. 7 is entered at connection terminal 3024 and proceeds to decision symbol 4002 whose instructions determine if the actual time at the moment is greater than the remaining operating time of the start/stop control TOVER, that is, to determine if the air handling units have been activated far enough in advance to achieve the desired temperature change. In both yes and no responses, a subsequent decision symbol 4004 and 4008, respectively, inquire if the value of DSAT i.e., the difference between the space air temperature and the high limit temperature is equal to zero. If DSAT equals zero, no adjustment to the lead-time parameter needs to be made, and the routine proceeds to instructions of process symbol 4010 which through the storage matrix VARSS locates the location in the LDTIME matrix containing the lead-time requiring alteration. This location is designated by the indexes JJ and II.

If the actual time is less than TOVER and the differential between IHLT and ISAT is greater than zero, the routine proceeds to return process symbol 4028 which returns to routine C which examines the next cooling unit.

If the response is no to instructions of decision symbol 4004, routine D proceeds to decision symbol 4012 which determines if the control routine is in a start-up or shutdown mode. In both instances following decision symbol 4008 and decision symbol 4012, the instructions of routine D proceed to process symbols 4014, 4016 and 4018 which are operative to adjust the start/stop parameters of the LDTIME matrix.

Figure 5:
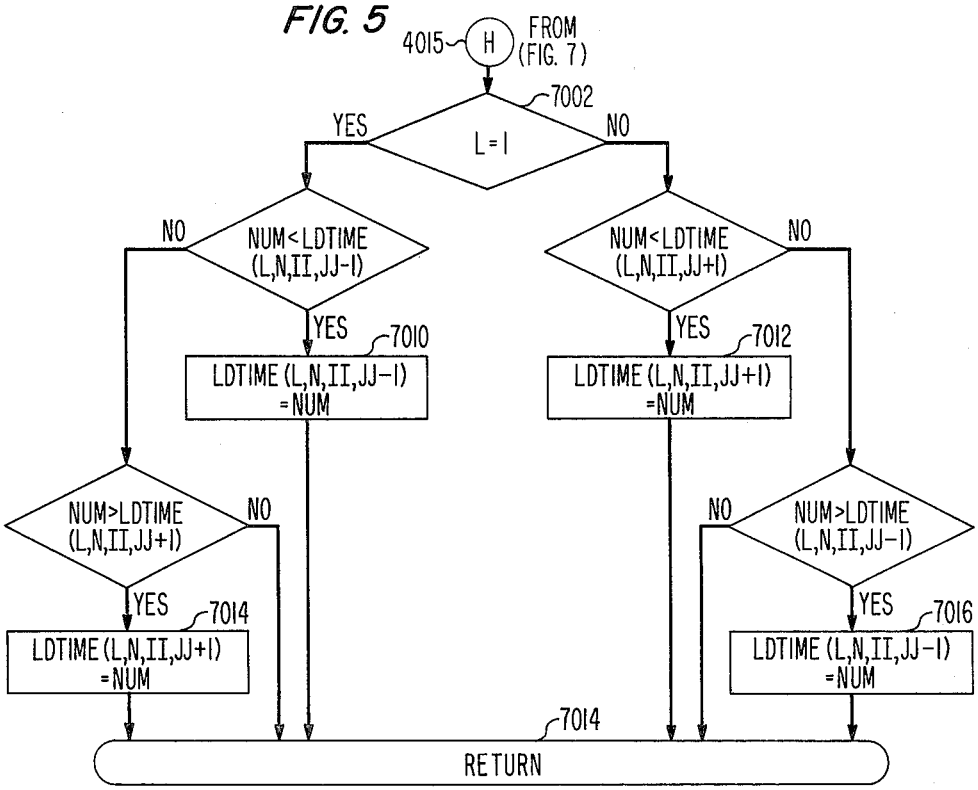

Routine H, shown in FIG. 5, is engaged in connection symbol 4015 following process symbol 4014 for the purpose of evaluating the reasonableness of the matrix elements just calculated. The instruction in decision symbol 7002 determine if the overall program is in a start or stop mode. In either case, the elements populating a particular slot in the LDTIME matrix are compared with adjacent elements to determine if their values are reasonable. These actions may be readily ascertained by examining the inequalities expressed in the operative symbols of the flow diagram in FIG. 7 and need not be explained herein in detail.

In those instances where the element is not deemed reasonable, the element is assigned a value equal to an existing adjacent element in the matrix as shown in process symbols 7010, 7012, 7014 and 7016.

The instructions return at return block 7014 to the routine D in FIG. 7 wherein, the value of the VARSS (N,2) matrix element is set equal to zero by instructions at process symbol 4022. NCOUNT is decremented in the next process symbol 4024. NCOUNT is a variable used to keep track of how many air handling units have been covered. When all units have been considered and NCOUNT is determined to be zero in decision symbol 4026, routine D proceeds to terminal 4030 to return to the main routine in FIG. 3. When NCOUNT does not equal zero, the routine returns via block 4028 to routine C which continues as described above.

When all air handling or cooling units have been evaluated in routines C and D, the program returns from routine C to routine A in FIG. 4 wherein the STATUS number is evaluated in decision symbol 2008. The value of the STATUS number is initially set to zero in the main routine process symbol 1004 of FIG. 3. Its value is set equal to one in routine E, as described below, when the actual time TACT has exceeded the unoccupied time TUNOC or the occupancy time TOC. If the value of STATUS equals one, the program returns to routine C; if it equals zero, routine A proceeds to the decision symbol 2010 to determine if the actual time is greater than or equal to the critical time determined in the main routine. If the actual time is less then the critical time, the routine A flows to process symbol 2002 to read the outside air sensors wherein routines C and D are again engaged. If the actual time is greater than or equal to the critical time, the program proceeds via terminal symbol 2012 to routine E.

The routine E disclosed in FIG. 8 is engaged for determining if the time TOC or TUNOC when occupancy or unoccupancy occurs has been reached without certain of the air handling units being switched or activated. Routine E is entered in terminal 2022 and proceeds to process symbol 8004 setting N equal to one and NCOUNT equal to zero. If the VARSS (N,3) matrix element is greater than zero, as determined by decision symbol 8006, the routine determines in decision symbol 8008 if the routine is in a start or stop mode, depending on the mode that the system is in, the Nth air handler is either turned-on or off in process symbols 8010 or 8012, respectively. The JOAT value is entered for the VARSS (N,3) matrix element in process symbol 8014, and N is incremented in process symbol 8016, and if decision symbol 8018 determines that all air handling units have not been covered, the process is repeated via decision symbol 8006.

If the VARSS (N,2) matrix element is greater than zero, the value NCOUNT is incremented by one in process symbol 8024, and N is incremented by one in process symbol 8016. If VARSS (N,2) is less than or equal to zero as determined by decision symbol 8015, just N is incremented and the next air handling unit is accessed, since it indicates that this particular unit has had its lead-time parameter contained in the LDTIME matrix adjusted; refer to module D, symbol 4022. Conversely, when VARSS (N,2) is greater than zero indicating that the lead-time parameter has not been adjusted the variable NCOUNT, which is used to count the number of air handling units yet to have their lead-time parameters altered, is incremented by one.

When decision symbol 8028 indicates that all unexercised air handling units have been considered, the routine returns via terminal 8030 to the main routine if NCOUNT equals zero. If NCOUNT does not equal zero, STATUS is set equal to one in process symbol 8032, and, after a five-minute delay, the actual time is read and the routine returns via terminal 8040 to routine A in FIG. 4.

Figure 9:
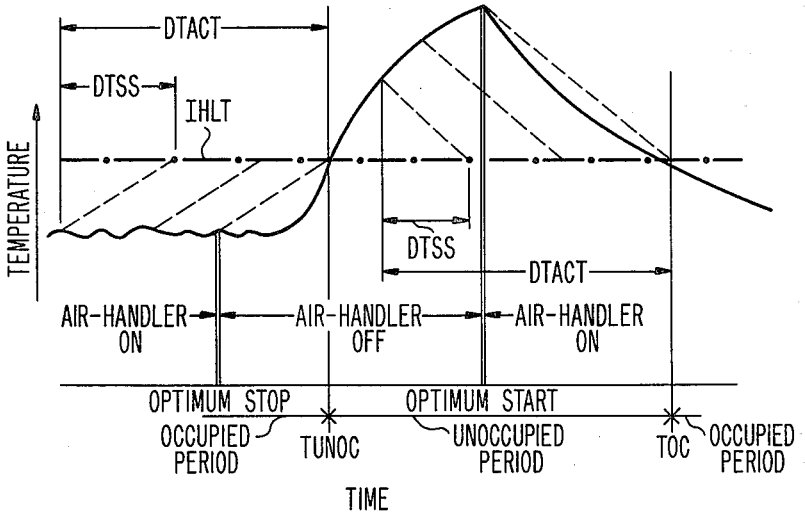
FIG. 9 is a time-temperature graph showing the space temperature response of a typical building in response to optimizing the switching of building space air temperature controls.

The temperature control characteristic which can be achieved by a control system utilizing the present invention is shown in FIG. 9, where it can be seen that a high temperature before occupancy is reduced to the limit temperature at occupancy and allowed to float to this temperature at the end of occupancy. During off hours, the temperature is allowed to float to high levels.

What is claimed is:

1. A method of determining optimum start/stop times for an air handling unit in order to achieve a predetermined limit temperature within a building space controlled by the air handling unit at some preassigned time comprising the steps of:

sensing an outside temperature outside a building encompassing the building space from an outside array of binary temperature sensors covering a range of outside temperatures and resolving it into quantum levels and assigning a unique integer J to a particular quantum level of the outside temperature sensed sensing an inside building space temperature within the building space controlled by the air handling unit from an inside array of binary temperature sensors covering a range of inside temperatures and resolving it into quantum levels and assigning a unique integer I to a particular quantum level of the inside building space temperature sensed storing in a memory an array of start/stop parameter elements having a dimensionality of lead-time and having an individual parameter element associated with each pair of unique integers I and J assigned to the quantum levels of inside and outside air temperature determining a time interval required to achieve the predetermined limit temperature by activating-/deactivating an air handling unit by accessing a start/stop parameter element associated with an integer pair of integer I representing the present building space air temperature quantum level and integer J representing the present quantum level of outside air temperature, and computing if a time interval between present time and preassigned time equals the time interval to achieve the predetermined limit temperature and activating/deactivating the air handling unit when they are substantially equal.

2. A method of determining optimum start/stop times for an air handling unit as defined in claim 1 where the method of determining a time interval further includes the steps of;

determining if the time interval determined is less than a time interval for a high value of J previously derived and greater than a time interval for a lower value of J previously determined, and replacing the time interval determined by one of these two values if its value is outside these limits.

3. A method of determining optimum start/stop times for an air handling unit as defined in claim 1 and further including the steps of recording an actual time when an air handling unit is activated/deactivated interrogating the inside array of binary temperature sensors at a time the air handling unit is activated/-deactivated and recording an integer I associated with a quantum level of that temperature interrogating the outside array of binary temperature sensors at a time the air handling unit is activated/-deactivated and recording an integer J associated with a quantum level of that temperature storing these I and J values recorded at the time of activation/deactivation in memory and computing a time interval between actual time predetermined limit temperature is attained and time of activation/deactivation between a present space air temperature and a building space air temperature at time of activation/deactivation, and replacing the start/stop parameter element used previously to compute the time interval required to achieve the predetermined limit temperature with the new start/stop parameter element associated with a same quantum level of building space and outside air temperatures.

4. A method of determining optimum start/stop times for an air handling unit as defined in claim 3 and further including the steps of interrogating if the air handling unit has been activated/deactivated upon reaching the preassigned time and activating/deactivating it if it was not previously activated/deactivated.

5. A method of determining optimum start/stop times for an air handling unit as defined in claim 4 and further including the steps of periodically checking actual times with selected preassigned times to determine if an air handling unit should be activated and to determine if an air handling unit should be deactivated.

6. A control system for determining optimum start/-stop times for an air handling unit in order to achieve a predetermined limit temperature within a building space controlled by the air handling unit at some preassigned time comprising the steps of first temperature sensing means for sensing an outside temperature outside a building encompassing the space from an outside array of binary temperature sensors covering a range of outside temperatures and resolving it into quantum levels and assigning a unique integer J to a particular quantum level of the outside temperature sensed, second temperature sensing means for sensing an inside space temperature within the space controlled by the air handling unit from an inside array of binary temperature sensors covering a range of inside temperatures and resolving it into quantum levels and assigning a unique integer I to a particular quantum level of the inside space temperature sensed, memory means for storing an array of start/stop parameter elements having a dimensionality of lead-time and having an individual parameter element associated with each unique integer I and J assigned to the quantum levels of inside and outside temperature means for determining a time interval required to achieve the predetermined limit temperature by activating/deactivating an air handling unit by accessing a start/stop parameter element associated with an integer pair of integer I representing the present space air temperature quantum level and integer J representing the quantum level of outside air temperature quantum level, and means for computing if a time interval between present time and preassigned time equals the time interval to achieve the predetermined limit temperature and switching means for activating/deactivating the air handling unit when they are substantially equal.

7. A control system for determining optimum start/-stop times for an air handling unit as defined in claim 6 wherein the control system is adapted for controlling a plurality of air handling units and further including individual temperature sensing means for sensing air inside space temperatures associated with each individual air handling unit, and the means for determining including start/stop parameter elements associated with each individual air handling unit.

8. A method of controlling optimum start/stop times for an air handling unit in order to achieve a desired temperature limit in a particular air space at a preassigned time comprising the steps of:

quantizing an outside air temperature into a discrete level identified by an integer J, including the substeps of presetting an array of binary temperature sensors so that each sensor switches at a different temperature with individual temperature levels distributed over a range of interest, scanning sensor switch states and associating each combination of switch states with a unique integer J, quantizing an air space temperature into a discrete level identified by an integer I, computing a lead-time needed for achieving a desired temperature limit for a preset temperature for different integers I and J, activating an air handling unit at a preset time when the lead-time represents a time value that added to the present time equals the preassigned time.

9. A method of controlling optimum start/stop times for an air handling unit in order to achieve desired temperature limit in a particular air space at a preassigned time comprising the steps of;

quantizing an outside air temperature into a discrete level identified by an integer J, quantizing an air space temperature into a discrete level identified by an integer I, including the substeps of presetting an array of binary temperature sensors so that each sensor switches at a different temperature with individual temperature levels distributed over a range of desired temperatures, scanning sensor switch states and associating each combination of switch states with a unique integer I, computing a lead-time needed for achieving a desired temperature limit for a preset temperature for different integers I and J.

activating an air handling unit at a preset time when the lead-time represents a time value that added to the present time equals the preassigned time.

10. A method of controlling optimum start/stop times for an air handling unit as defined in claim 8 or 9 wherein the step of computing lead-times comprises the step of;

comparing computed lead-times for specific I,J values with lead-times associated with adjacent I,J values and considering lead-times associated with adjacent I,J values to be limit values for limiting the values of the computed lead-times.

11. A method of controlling optimum start/stop times for an air handling unit as defined in claim 8 or 9 wherein the step of computing a lead-time comprises the steps of;

assigning specific lead-times to specific combinations of the integers I and J and arranging in a tabular form comparing specific lead-times with actual time intervals needed to achieve a desired temperature and adjusting lead-times to match actual performance.

12. A method of controlling optimum start/stop times for an air handling unit in order to achieve a desired temperature limit in a particular air space at a preassigned time comprising the steps of;

measuring an outside air temperature by subdividing a temperature range into a plurality of quantized temperature gradations and assigning a specific integer J to the outside temperature in accord with a temperature gradation in which it is located, measuring an air space temperature by subdividing a temperature range into a plurality of quantized temperature gradations and assigning a specific integer I to the air space temperature in accord with a temperature gradation in which it is located, computing a lead-time needed for achieving a desired temperature limit for a preset temperature for different integers I and J, activating an air handling unit at a preset time when the lead-time represents a time value that added to the present time equals the preassigned time.

13. A method of controlling space air temperatures in a building comprising the steps of;

measuring an outside air temperature outside the building by utilizing a first range of temperature divided into a plurality of quantum levels and converting the outside air temperature into an integer J corresponding to the quantum level of the outside air temperature, measuring an inside air temperature inside a space to be controlled by utilizing a second range of temperature divided into a plurality of quantum levels and converting the inside air temperature into an integer I corresponding to the quantum level of the inside air temperature, compiling a table of lead-times for each combination of inside and outside air temperature integers I and J that are necessary for establishing a desired temperature in an air space after activation/deactivation of an air handling unit, and monitoring results of activation/deactivation of an air handling unit and modifying lead-times in the table to correspond to actual performance times.

14. A method of controlling space air temperatures in a building as defined in claim 13 further comprising the steps of monitoring real time for determining an appropriate activation/deactivation mode of operation, and determining if available time to time when desired temperature is to be achieved is adequate.

15. A method of controlling space air temperatures in a building comprising the steps of;

converting an air temperature outside the building to an integer representing a quantum level representing the air temperature, converting an air temperature inside a space to be controlled to an integer representing a quantum level representing the air temperature, compiling a table of lead-times for each combination of outside and space air temperature quantum levels for amount of time to establish a desired temperature in an air space activation/deactivation of an air handling unit, and monitoring results of activation/deactivation of an air handling unit and modifying lead-times in the table to correspond to actual performance times, the step of monitoring including substeps of establishing a table of time intervals required from activation/deactivation to a desired temperature level, and comparing time intervals required for a particular combination of outside and inside air temperature quantum levels with adjacent lead-times to determine reasonableness of modified lead-times and substituting a lead-time of adjacent quantum levels if it is not reasonable.

* * * * *